United States Patent [19]

Fischer

[11] 4,297,787

[45] Nov. 3, 1981

[54] INSULATED GAUGE ROD AND METHOD OF MAKING THE SAME

[76] Inventor: Carlin P. Fischer, 6336 S. 72nd Ave., Omaha, Nebr. 68127

[21] Appl. No.: 141,168

[22] Filed: Apr. 17, 1980

[51] Int. Cl.[3] ..... B61K 9/08; E01B 35/02

[52] U.S. Cl. ..... 33/144; 238/53

[58] Field of Search ..... 33/143 R, 144, 146, 33/158, 168 R, 168 B, 159; 238/53; 254/43, 100; 403/268, 265, 267

[56] References Cited

U.S. PATENT DOCUMENTS

| | | | |
|---|---|---|---|
| 645,087 | 3/1900 | Green | 33/144 |
| 1,226,571 | 5/1917 | Mueller | 238/52 |
| 1,585,495 | 5/1926 | Heyl et al. | 238/53 |
| 2,085,599 | 6/1937 | Paluch | 33/144 |
| 4,110,650 | 8/1978 | Kemp et al. | 403/265 X |
| 4,130,926 | 12/1978 | Willem | 403/268 X |
| 4,141,554 | 2/1979 | Sherwin | 403/268 X |

*Primary Examiner*—Harry N. Haroian

*Attorney, Agent, or Firm*—Zarley, McKee, Thomte, Voorhees & Sease

[57] ABSTRACT

An insulated gauge rod is disclosed which comprises a fiberglass rod secured to and extending between a pair of metal castings which are threadably mounted on the ends of metal rods which are secured to the spaced-apart railroad tracks. Each of the castings is provided with a cavity at one end thereof which receives one end of the fiberglass rod. The interior wall surface of the cavity is provided with a plurality of spaced-apart ridges defining frusto-conical shaped cavities therebetween. An epoxy material secures the fiberglass rod to the casting. The method of securing the fiberglass rod to the casting is also described.

5 Claims, 6 Drawing Figures

INSULATED GAUGE ROD AND METHOD OF MAKING THE SAME

BACKGROUND OF THE INVENTION

This invention relates to an insulated gauge rod and more particularly to an insulated gauge rod which has superior insulating and durability characteristics.

Gauge rods have been used for many years to maintain railroad tracks in a predetermined spaced-apart condition. The conventional gauge rods may either have single or double ends which are secured to the tracks. The first gauge rods employed by the railroad were of a metal material but it became necessary to provide some method of electrically insulating the ends of the gauge rods from each other since the railroad tracks are frequently used to conduct electricity for signalling purposes, etc.

Many types of gauge rods havve been provided which are insulated but they are extremely elaborate and expensive. Further, certain of the insulated gauge rods are not sufficiently durable which necessitates constant maintenance and replacement.

Therefore, it is a principal object of the invention to provide an improved insulated gauge rod.

A still further object of the invention is to provide an insulated gauge rod having superior strength characteristics.

A still further object of the invention is to provide an insulated gauge rod which is unaffected by weather conditions.

A still further object of the invention is to provide an insulated gauge rod which is economical of manufacture, durable in use and refined in appearance.

These and other objects will be apparent to those skilled in the art.

SUMMARY OF THE INVENTION

The insulated gauge rod of this invention comprises a fiberglass rod which is secured to and which extends between a pair of metal castings threadably mounted onto the ends of metal gauge rod portions which are secured to spaced-apart railroad tracks. The ends of the fiberglass rod are received by a cavity in the casting which has a plurality of spaced-apart ridges which define frusto-conical shaped cavities therebetween which receive an epoxy material which secures the fiberglass rod to the metal casting. The fiberglass rod is secured to the casting as follows:

1. The casting is stoppered at its threaded end and the multi-tapered cavity is filled with a mold release agent which is allowed to soak for approximately twenty minutes.

2. The mold release agent is removed from the cavity and replaced with approximately two ounces of a two-part epoxy adhesive.

3. One end of the fiberglass rod is then buffed to remove the exterior resin and to expose the glass filaments therein.

4. The fiberglass rod is then placed into the casting cavity and placed in a curing oven for two hours at 150° F.

5. The rod and casting are removed from the oven, cooled and inverted into a second casting which has been prepared according to the procedures outlined above.

After heat curing the entire assembly, a tensible load of approximately 42,000 pounds is applied to the assembly to set the wedge.

DESCRIPTION OF THE PREFERRED EMBODIMENT

Figure 3:
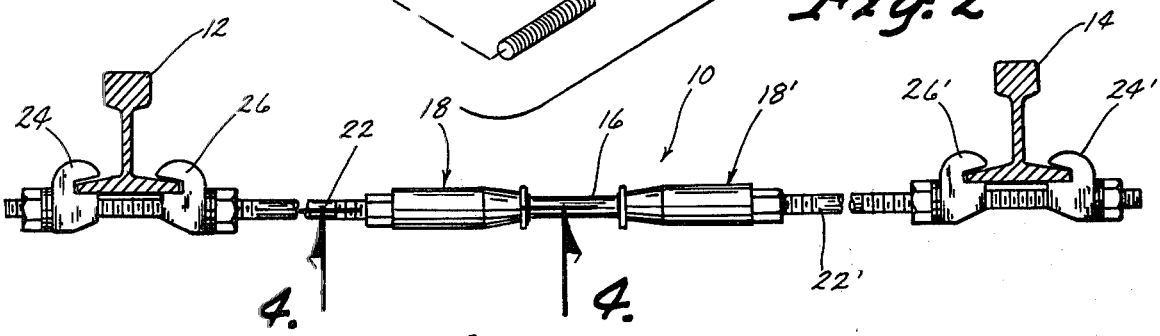
FIG. 3 is a sectional view as seen on lines 3—3 of FIG. 1.
Figure 5:
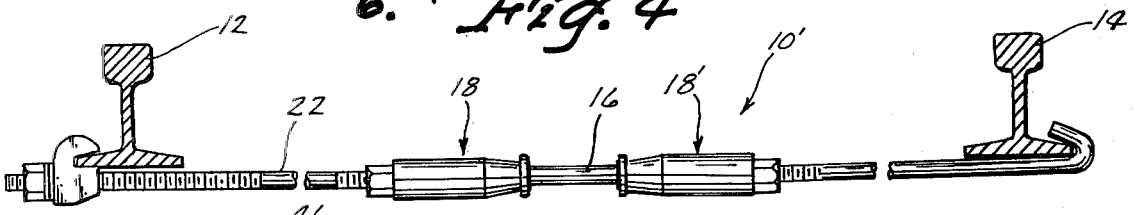
FIG. 5 is a view similar to FIG. 3 except that the gauge rod is of the single-end type.
Figure 6:
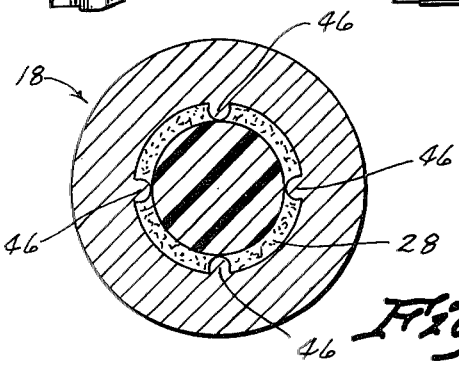
FIG. 6 is a sectional view seen on lines 6—6 of FIG. 4.

The insulated gauge rod of this invention is referred to generally by the reference numeral 10 and is designed to be extended between a pair of tracks 12 and 14. FIG. 3 illustrates the gauge rod 10 as being of the double-end type while FIG. 5 illustrates the gauge rod 10' as being of the single-end type. In the embodiment of FIG. 3, the tracks 12 and 14 are prevented from separation and are prevented from moving towards one another. The gauge rod 10' of FIG. 5 only prevents the tracks 12 and 14 from separating.

Figure 1:
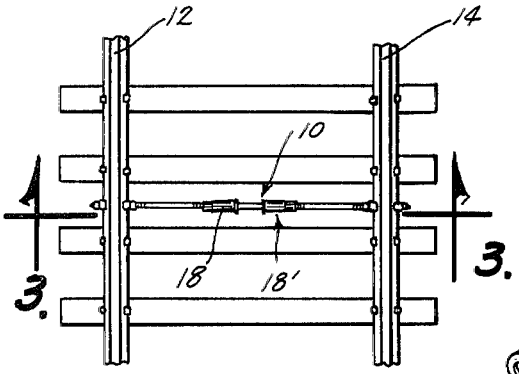
FIG. 1 is a plan view of the gauge rod of this invention connecting a pair of railroad tracks.
Figure 2:
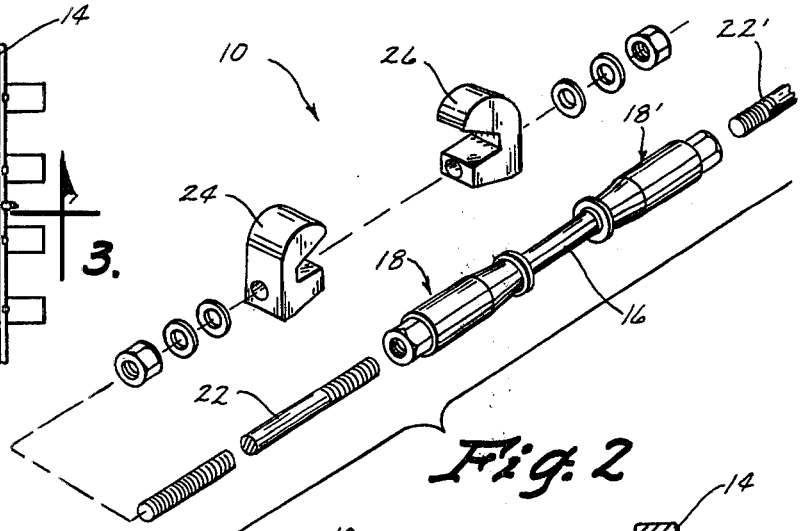
FIG. 2 is an exploded perspective view of the gauge rod of this invention.
Figure 4:
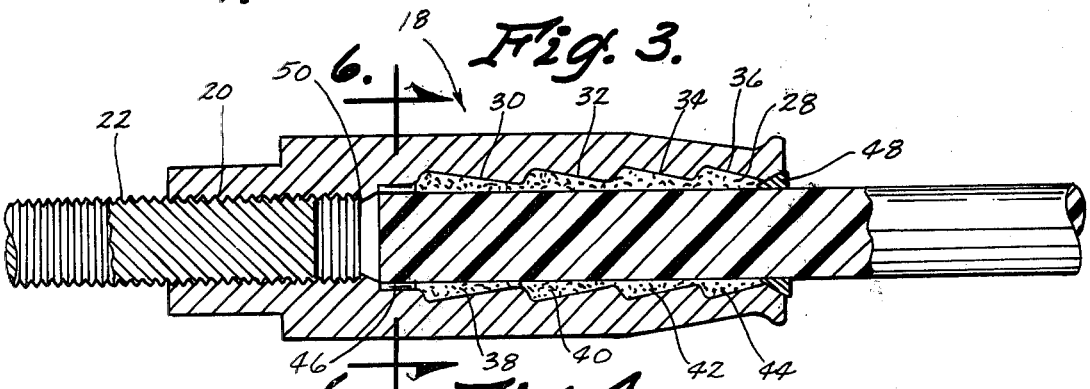
FIG. 4 is a sectional view seen on lines 4—4 of FIG. 3.

Referring to FIGS. 2 and 3, the numeral 16 refers to a fiberglass rod which is secured to and which extends between a pair of metal castings 18 and 18' which are identical to each other. As seen in FIG. 4, one end of casting 18 is provided with internal threads 20 to enable the metal rod portion 22 to be threadably received thereby. The other end of metal rod portion 22 is provided with the elements or connectors 24 and 26 which are secured to the track 12 as illustrated.

Metal rod portion 22' is threadably secured to casting 18' and is provided with the elements 24' and 26' at its other end which are secured to the track 14 as illustrated.

Casting 18 is provided with a cavity 28 at its other end which receives the fiberglass rod 16 as best illustrated in FIG. 4. The interior of cavity 28 is provided with a plurality of spaced-apart ridges 30, 32, 34 and 36 which define frusto-conical shaped cavities 38, 40, 42 and 44. Casting 18 is also provided with a plurality of spaced-apart protrusions 46 at the inner end of the cavity 28 which serve to center the inner end of the fiberglass rod 16. The space between the protrusions 46 also provide a vent opening for the epoxy material to escape therethrough during the attachment process. The numeral 48 refers to a wedge-shaped collect comprised of a plastic material which embraces the fiberglass rod 16 at the entrance of the cavity 28 to also aid in centering the fiberglass rod 16 with respect to the cavity 28.

The method of securing the fiberglass rod 16 to the casting 18 is as follows. The casting 18 is stoppered at 50 and a mold release agent is inserted into the cavity 28. A suitable mold release agent is part No. 225 manufactured by Ram Chemical Company of Gardena, Calif. The mold release agent is allowed to soak in the cavity 28 for approximately twenty minutes at which time it is removed and replaced with approximately two ounces of a two-part epoxy adhesive. The resin component of the epoxy adhesive is preferably Epoweld No. 3243 (Part A) with the hardener component of the epoxy adhesive also being identified as Epoweld No. 3243 (Part B). Epoweld No. 3243 is manufactured by Hardman Company, Belleville, N.J. The mixed ratio of the epoxy adhesive is 100 parts by weight of the resin component and 72 parts by weight of the hardener component.

The fiberglass rod 16 is then buffed with 50 grit sandpaper to remove the exterior resin and to expose the fiberglass filaments. One end of the rod 16 is then placed into the casting cavity 28 so that the inner end is centered by the protrusions 46. The collet 48 is also placed into position to center the fiberglass rod 16.

Rod 16 and the casting 18 are then placed in a curing oven for two hours at 150° F. The rod and casting are then removed from the oven, cooled and inverted into the casting 18' which has been prepared identically to the procedures described hereinabove. The entire assembly is again cured for two hours at 66° C. Heat curing is preferred in this instance to provide maximum initial lap shear strength.

The finished assembly comprising rod 16 and castings 18 and 18' is cooled and placed in an assembly where a tensible load of approximately 42,000 pounds is applied to the same to accomplish a procedure termed "setting the wedge". By applying the mold release agent to the casting, a reduction in the adherence of the two-part epoxy adhesive to the interior casting cavity is accomplished. By applying the tensible load, the fiberglass rod and the epoxy adhesive have become one single newly configured series of four wedges defined by the cavities 38, 40, 42 and 44. As more tensible load is applied to the assembly, more perpendicular compression forces are applied to the fiberglass rod. Laboratory tests have revealed that no appreciable separation or damage occurrs to the assembly in tests wherein approximately 100,000 pounds of load have been applied to the assembly.

The insulated gauge rod of this invention provides an insulating assembly which is stronger than steel components and provides a much greater insulating capacity over those being offered for sale. The primary advantages of the insulating components of this invention are that it has over twice the tensible strength of common Number 1020 hot rolled steel being used as the metal components of the rod and does not deteriorate due to constant changes in weather conditions.

Thus it can be seen that a novel insulated gauge rod has been provided which does accomplish at least all of its stated objectives.

I claim:

1. An insulated gauge rod, comprising, a first metal rod portion having means on one end thereof for engagement with one railroad track of a pair of tracks, a first metal hollow casting secured to the other end of said first metal rod portion, a second metal rod portion having means on one end thereof for engagement with the other railroad track of the pair of tracks, a second metal hollow casting secured to the other end of said second metal rod portion, a fiberglass rod secured to and extending between said first and second castings for electrically insulating said first and second rod portions from each other, each of said castings having open opposite ends, one end of each of said castings being threadably secured to the associated metal rod portion, the other end of each of said castings receiving one end of the said fiberglass rod, an epoxy material securing said fiberglass rod to said casting, each of said castings including means for centering said fiberglass rod therein.

2. The gauge rod of claim 1 wherein said means for centering said fiberglass rod comprises an electrically insulative collet which embraces said fiberglass rod at the said other end of said casting.

3. The gauge of claim 2 wherein said means for centering said fiberglass rod also comprises a plurality of spaced-apart protrusions in said casting which engage the inner end of said fiberglass rod.

4. The method of making an insulated gauge rod, comprising the steps of:

(1) providing a pair of casting having first and second ends;

(2) providing a fiberglass rod;

(3) creating internal threads at one end of each of the castings;

(4) creating an internal cavity in the other end of the castings which defines a plurality of spaced-apart frusto-conical shaped cavity portions;

(5) treating the internal cavity of one of said castings with a mold release agent;

(6) buffing the ends of the fiberglass rod to expose the glass filaments therein;

(7) placing an epoxy adhesive in the said one cavity;

(8) positioning one end of the fiberglass rod in said one cavity;

(9) placing the rod and casting in a curing oven for a predetermined length of time at a predetermined temperature;

(10) removing the casting and rod from the oven;

(11) treating the cavity in the other casting according to step (5);

(12) placing an epoxy adhesive in the said cavity;

(13) positioning the other end of the fiberglass rod in the said cavity;

(14) placing the rod and castings in a curing oven for a predetermined length of time at a predetermined temperature;

(15) removing the rod and castings from the oven and cooling the same;

(16) applying a tensible load to the rod and castings to separate the adhesive from the wall surface in each of the cavities;

(17) positioning a gauge rod end in each of the said one end of each of the castings.

5. An insulated gauge rod, comprising, a first metal rod portion having first and second ends, said first metal rod portion having means at its first and thereof for engagement with one railroad track of a pair of tracks and thread means at its second end, a first metal hollow casting threadably secured to the said second end of said first metal rod portion, a second metal rod portion having first and second ends, said second metal rod portion having means at said first end thereof for engagement with the other railroad track of the pair of tracks and thread means at its second end, a second metal hollow casting threadably secured to the said second end of said second metal rod portion, a fiberglass rod secured to and extending between said first and second castings for electrically insulating said first and second rod portions from each other, each of said castings having open opposite ends, one end of each of said castings threadably receiving the said second end of the associated metal rod portion, the other end of each of said castings receiving one end of the said fiberglass rod, an epoxy material securing said fiberglass rod to said casting, the said open other ends of each of said castings having interior surfaces formed therein for receiving the epoxy material to prevent the separation of said fiberglass rod therefrom, said interior surfaces comprising a plurality of spaced-apart annular ridges defining frusto-conical shaped cavities which receive a portion of the epoxy material.

* * * * *